US009255476B2

(12) United States Patent
Mancini et al.

(10) Patent No.: US 9,255,476 B2
(45) Date of Patent: Feb. 9, 2016

(54) SHAFT CONSTRUCTION IN THE EARTH AND METHOD THEREOF

(71) Applicants: Steven M. Mancini, Clinton Township, MI (US); Edward A. Mancini, Bloomfield Hills, MI (US)

(72) Inventors: Steven M. Mancini, Clinton Township, MI (US); Edward A. Mancini, Bloomfield Hills, MI (US)

(73) Assignee: Ric-Man Construction, Inc., Sterling Heights, MI (US)

( * ) Notice: Subject to any disclaimer, the term of this patent is extended or adjusted under 35 U.S.C. 154(b) by 0 days.

(21) Appl. No.: 13/969,926

(22) Filed: Aug. 19, 2013

(65) Prior Publication Data

US 2014/0050531 A1 Feb. 20, 2014

Related U.S. Application Data

(60) Provisional application No. 61/684,558, filed on Aug. 17, 2012.

(51) Int. Cl.

| | |
|---|---|
| ***E02D 27/00*** | (2006.01) |
| ***E21D 5/11*** | (2006.01) |
| ***E21D 1/00*** | (2006.01) |

(52) U.S. Cl.
CPC ... *E21D 5/11* (2013.01); *E21D 1/00* (2013.01)

(58) Field of Classification Search
USPC ..... 405/229, 231, 232, 233, 236, 133, 132, 405/136, 150.1; 52/741.11, 741.15, 741.14; 404/25
See application file for complete search history.

(56) References Cited

U.S. PATENT DOCUMENTS

| | | | | |
|---|---|---|---|---|
| 413,383 | A | 10/1889 | Beecher | |
| 3,750,407 | A * | 8/1973 | Heierli et al. | 405/138 |
| 3,779,322 | A | 12/1973 | Stevens | |
| 4,107,930 | A | 8/1978 | Thiehofe | |
| 4,214,374 | A | 7/1980 | Miotti | |
| 4,401,397 | A | 8/1983 | Sommer | |
| 4,496,268 | A | 1/1985 | Ressi di Cervia | |
| 4,797,031 | A | 1/1989 | Hagimoto | |
| 5,261,766 | A | 11/1993 | Anderson | |
| 6,048,137 | A | 4/2000 | Beck | |
| 6,491,476 | B2 | 12/2002 | Hesse | |
| 2002/0124502 | A1 * | 9/2002 | Henderson | 52/296 |
| 2006/0275087 | A1 * | 12/2006 | Trout | 405/267 |
| 2009/0279960 | A1 * | 11/2009 | Hazzan | 405/233 |
| 2010/0135730 | A1 * | 6/2010 | Kristensen | 405/232 |

FOREIGN PATENT DOCUMENTS

| | | | |
|---|---|---|---|
| JP | 06193046 | * | 7/1994 |
| JP | 06248897 | * | 9/1994 |

* cited by examiner

*Primary Examiner* — Sean Andrish
(74) *Attorney, Agent, or Firm* — Reising Ethington P.C.

(57) ABSTRACT

A method of constructing a shaft in the earth for use as, for example, a launch shaft or a retrieval shaft, may include several steps. One step includes installing a secant pile wall into the earth. The secant pile wall encloses a portion of the earth. Another step includes excavating the portion of the earth enclosed by the secant pile wall. The excavated portion leaves an interior of the shaft and exposes an inside surface of the secant pile wall. Yet another step includes placing a metal liner within the interior of the shaft. And yet another step includes partially or more filling a space located between the inside surface of the secant pile wall and the metal liner with a grout material.

15 Claims, 6 Drawing Sheets

SHAFT CONSTRUCTION IN THE EARTH AND METHOD THEREOF

REFERENCE TO CO-PENDING APPLICATION

This application claims the benefit of U.S. Provisional Application No. 61/684,558 filed Aug. 17, 2012, which is incorporated herein by reference in its entirety.

TECHNICAL FIELD

The present disclosure relates generally to constructions and, more particularly, to shafts constructed in the earth.

BACKGROUND

Shaft constructions are made in the earth for a number of reasons, including for subaqueous tunneling projects. In these projects, underground tunnels are oftentimes excavated or dug below a body of water such as a river, a lake, a harbor, or a port. The underground tunnels can stretch below the body of water from one side of the body to the other side. Before the tunnels are excavated, a shaft is commonly constructed in the earth down to a vertical depth of tunnel excavation. Shafts are usually constructed at the beginning and at the end of underground tunnels for launching and retrieving excavation equipment and machinery, and for other purposes.

Earth below the surface near these types of shafts, however, tends to be porous and imbued with groundwater and often has a water table relatively close to its surface. The phrase "water table" is customarily used to describe the depth in the earth below the surface at which water pressure head is equal to atmospheric pressure—in simpler terms, it is where the earth below the surface becomes saturated with groundwater. Constructing shafts below water tables can be challenging because the saturated groundwater can easily seep into the shafts. And inflows of groundwater can hinder and sometimes thwart a shaft's usefulness and, in some cases, can ultimately delay the scheduled construction project and increase project costs.

SUMMARY

A method of constructing a shaft in the earth may include several steps. One step includes installing a secant pile wall into the earth. The secant pile wall encloses a portion of the earth. Another step includes excavating the portion of the earth enclosed by the secant pile wall. The excavated portion leaves an interior of the shaft and exposes an inside surface of the secant pile wall. Yet another step includes placing a metal liner within the interior of the shaft. And yet another step includes partially or more filling a space located between the inside surface of the secant pile wall and the metal liner with a grout material.

A shaft construction in the earth may include a secant pile wall, a metal liner, and a grout material. The secant pile wall has an inside surface and has multiple recesses at the inside surface. The metal liner is located interiorly of the secant pile wall. And the grout material is located between the secant pile wall and the metal liner. The grout material is located within the recesses of the secant pile wall.

A method of constructing a shaft in the earth may include several steps. One step includes installing a secant pile wall into the earth. The secant pile wall encloses a portion of the earth. Another step includes excavating the portion of the earth enclosed by the secant pile wall. The excavated portion leaves an interior of the shaft and exposes an inside surface of the secant pile wall. Yet another step includes forming one or more first recess(es) in the inside surface of the secant pile wall. And another step includes placing a metal liner within the interior of the shaft. The metal liner has one or more second recess(es) located in its structure. Another step includes partially or more filling a space located between the inside surface of the secant pile wall and the metal liner with a grout material. The grout material fills in the first recess(es) and fills in the second recess(es). Friction generated between the grout material and the first recess(es) and between the grout material and the second recess(es) withstand groundwater uplift forces.

BRIEF DESCRIPTION OF THE DRAWINGS

These and other objects, features, and advantages of the present invention will be apparent from the following detailed description of preferred embodiments and best mode, appended claims, and accompanying drawings in which:

DETAILED DESCRIPTION

Figure 1:
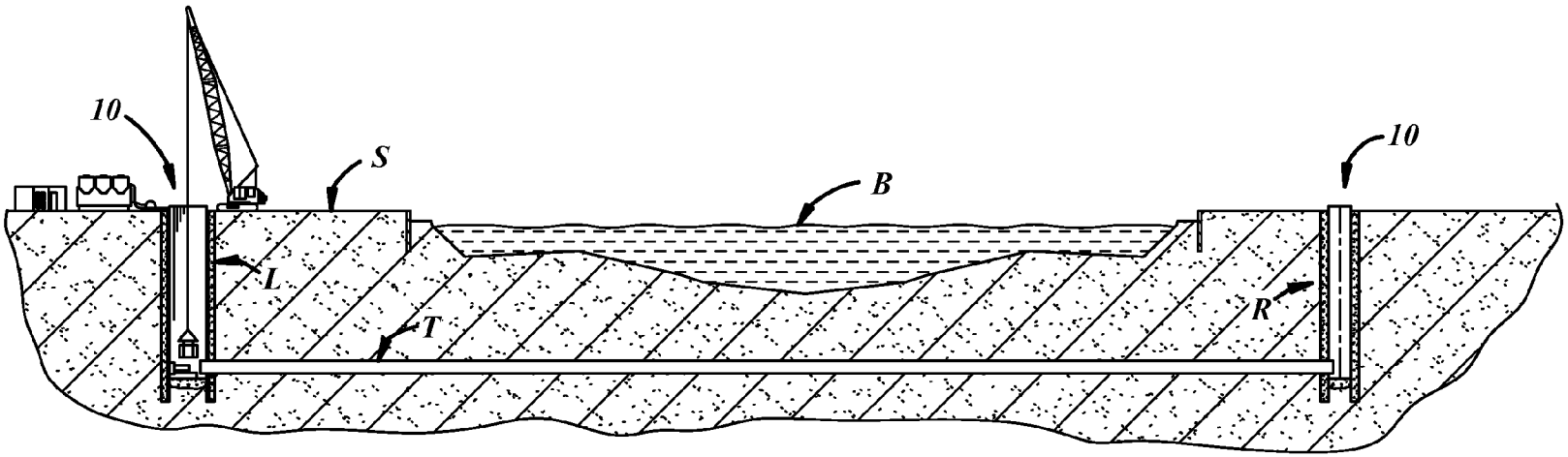
FIG. 1 is a sectional view of an example subaqueous tunneling project utilizing an embodiment of a shaft construction as described herein.

Referring in more detail to the drawings, FIG. 1 shows a pair of shaft constructions 10 made vertically below a surface S of the earth. In this example application, the shaft constructions 10 are part of an overall subaqueous tunneling project in which an underground tunnel T is excavated and stretches below a body of water B and between the shaft constructions. Here, one of the shaft constructions 10 is designated a launch shaft L for initiating the excavation and digging of the tunnel T via equipment and machinery, while the other shaft construction is designated a retrieval shaft R for recovering the equipment and machinery after tunnel construction. In these applications, the launch shaft L typically has a diameter greater than that of the retrieval shaft R—for example, an approximately twenty-four or twenty-two foot diameter launch shaft opening and an approximately thirteen or fifteen foot diameter retrieval shaft opening—and there can be numerous launch and retrieval shafts for a given construction project. Of course, other diameter values for the shafts are possible. Furthermore, the shaft constructions 10 can be made to a vertical depth of approximately one-hundred feet below the surface S and below the accompanying water table, and can be horizontally situated approximately one-hundred feet from the body of water B; of course, other depths and horizontal situations are possible in other projects. And though described in the context of a subaqueous tunneling project, the shaft constructions 10 shown and described herein could be used in other construction projects and applications, including those not necessarily near a body of water.

As an aside, and as used herein, the terms axial, radial, and circumferential and their related forms describe directions with respect to the generally cylindrical shape and longitudinal axis of the shaft construction 10, unless otherwise specified. In this sense then, axial refers generally to a vertical direction up and down relative to the surface S, radial refers generally to a side direction left and right and orthogonal to the axial direction, and circumferentially refers generally to a circular direction around the axial direction.

Each of the shaft constructions 10 has been designed generally for use below water tables and in conditions of the earth that are porous and imbued with groundwater. Their construction provides an improved seal against groundwater inflow compared to previously-known shaft constructions, and in some cases is altogether impermeable to groundwater. Taking one of the shaft constructions 10 for description purposes, the shaft construction can have various designs and components and can be made with various processes and process sequences, depending in part upon the application in which it will be used and the extent of impermeability desired, as well as other and different considerations. In the embodiment of the figures, the shaft construction 10 may be generally made via a pre-treating grout process, a secant pile wall installation process, a metal liner placement process, a base plug installation process, and a grout material filling process.

The pre-treating grout process is performed in order to condition a pre-established working zone so that the zone is suitable for subsequent processes in the formation of the shaft construction 10, by improving the strength of the earth beneath the working zone and by reducing its permeability, among other possible beneficial effects and objectives. The pre-treating grout process, however, is optional and need not be performed in some shaft constructions. Whether it is performed can depend upon assessments of the pre-established working zone site conditions and upon the particular application and project. The exact pre-treating grout process can vary among different projects and applications.

Figure 2:
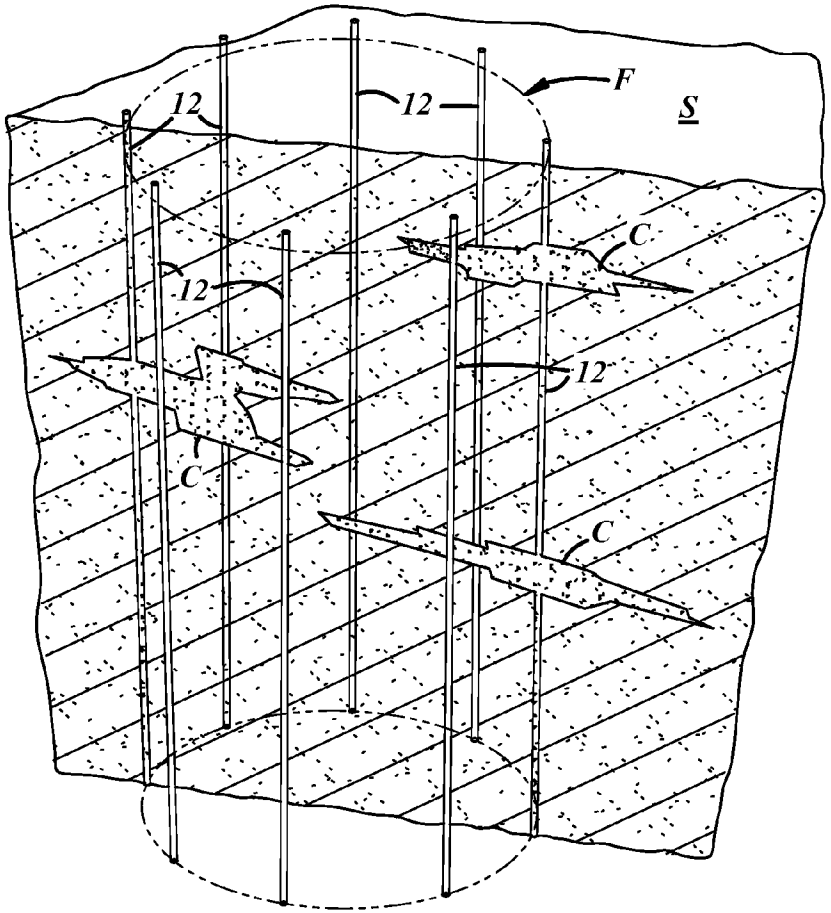
FIG. 2 is a fragmentary sectional view of an embodiment of a grout pre-treating that can be performed as a part of the shaft construction of FIG. 1.

Referring now to FIG. 2, in this embodiment eight grouting holes 12 are drilled into the earth and patterned around a footprint F, or general circumferential periphery, of the pre-established working zone and of the ensuing secant pile wall installation. More or less grouting holes 12 may be suitable in other embodiments. The working zone can be established based on planned routing of the underground tunnel, the conditions of the underlying earth, as well as other and different considerations. Once drilled, grouting machinery and equipment injects grouting material into the grouting holes 12 and disperses it vertically down the grouting holes to the depth of the shaft construction 10 and laterally into the surrounding earth. As shown as one example in FIG. 2, cavities C and other voids that are present in the earth can be filled by the injected grouting material. The exact grouting material used during this process can depend on the conditions of the underlying earth, and can be a chemical or cement based grouting material.

Figure 3:
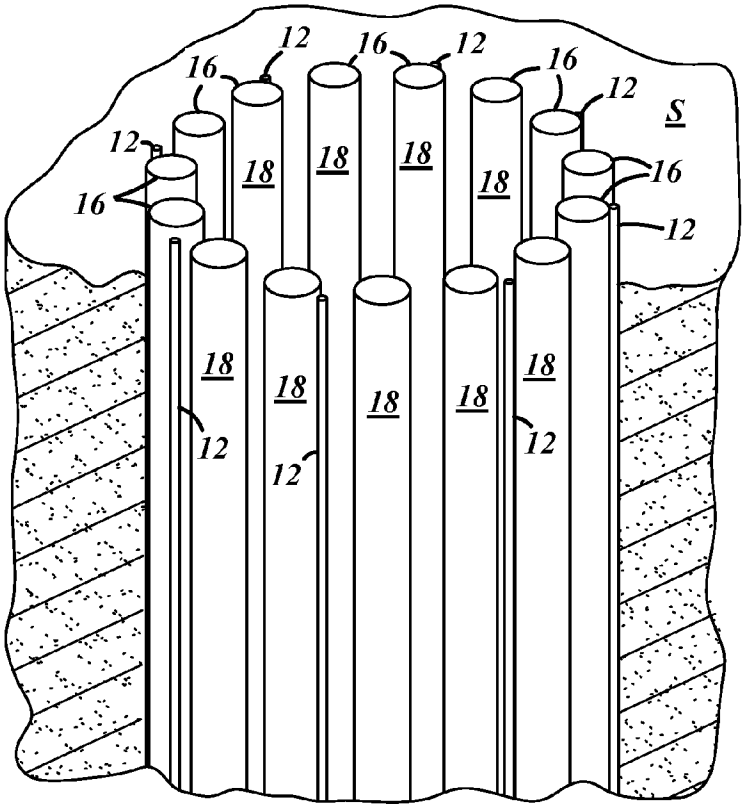
FIG. 3 is a fragmentary sectional view of an embodiment of a secant pile wall of the shaft construction of FIG. 1, the secant pile wall shown in the midst of its installation.
Figure 4:
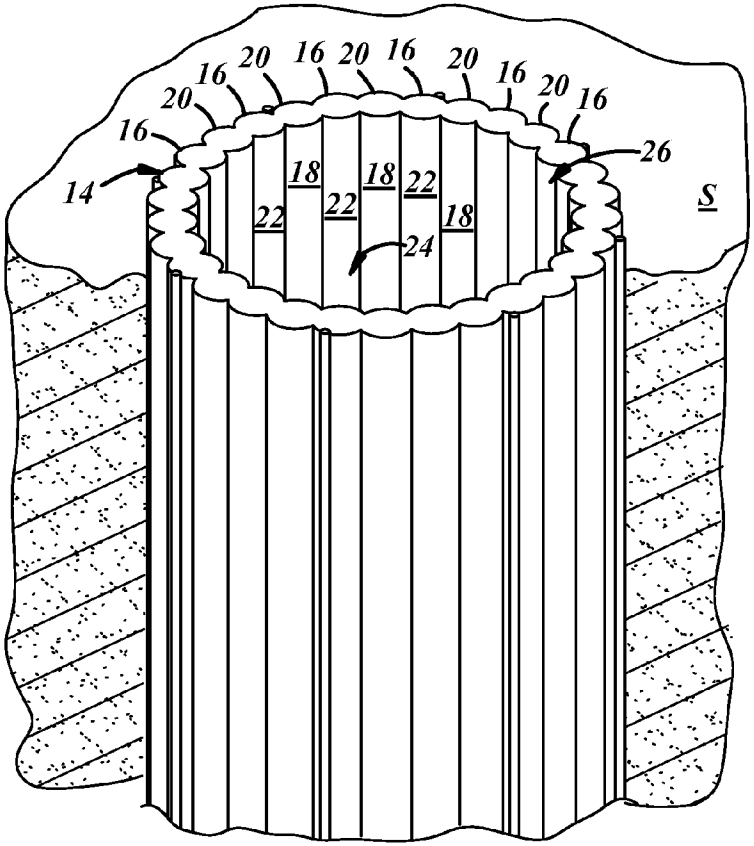
FIG. 4 is a fragmentary perspective view of the secant pile wall of FIG. 3, shown fully installed in the earth.

After pre-treating, if it is indeed performed, the secant pile wall installation process frames an outer cylindrical boundary into the earth of the shaft construction 10. Referring now to FIG. 4, a resulting secant pile wall 14 serves as the primary structural support of the shaft construction 10. The exact secant pile wall installation process can vary among different projects and applications. In the embodiment of FIGS. 3 and 4, a first set of secant pile holes 16 is initially drilled into the earth adjacent the grouting holes 12, with individual pile holes spaced away from one another in a generally circular pattern (FIG. 3 shows this best). Concrete material is then forced into the secant pile holes 16 and allowed to harden and solidify in order to form a first set of secant piles 18.

After this, a second set of secant pile holes 20 (FIG. 4) is drilled into the earth at the spaces and locations between the individual piles of the first set of secant piles 18. Because the spaces between the first set of secant piles 18 are dimensioned and measure less than a diameter of individual holes of the second set of secant pile holes 20, the second set of holes are physically cut into the sides of the concrete material of the first set of piles. In other words, the first and second set of secant pile holes 16, 20—and thus the first and second sets of concrete secant piles—have neighboring holes and piles that intersect and overlap one another at their outer peripheries. As before, concrete material is forced into the second set of secant pile holes 20 and allowed to harden in order to form a second set of secant piles 22.

As shown in FIG. 4, once fully hardened, the first and second set of secant piles 18, 22 produce the continuous and integral secant pile wall 14. In one specific example, the individual neighboring secant piles overlap each other by approximately ten inches and the secant pile wall has a radial thickness of approximately fourteen inches; of course, other values of overlap and thickness are possible in other embodiments. Furthermore, the exact concrete material used during this installation can depend on the conditions of the underlying earth. In one specific example, a cement/bentonite concrete material is used. In other embodiments not shown in the figures, the secant pile wall could be made by other secant pile formation techniques, including one in which a concrete material is poured to form a hollow cylinder.

Although not shown in FIG. 4, when initially produced the secant pile wall 14 encloses a portion of the earth radially-inwardly and inboard of the secant pile wall. The enclosed portion is subsequently excavated and removed out of the secant pile wall enclosure, leaving in some instances a somewhat empty an interior 24 of the shaft construction 10 and exposing an inside surface 26 of the secant pile wall 14. Dewatering within the interior 24 can be performed at this stage, though it need not be.

Figure 7:
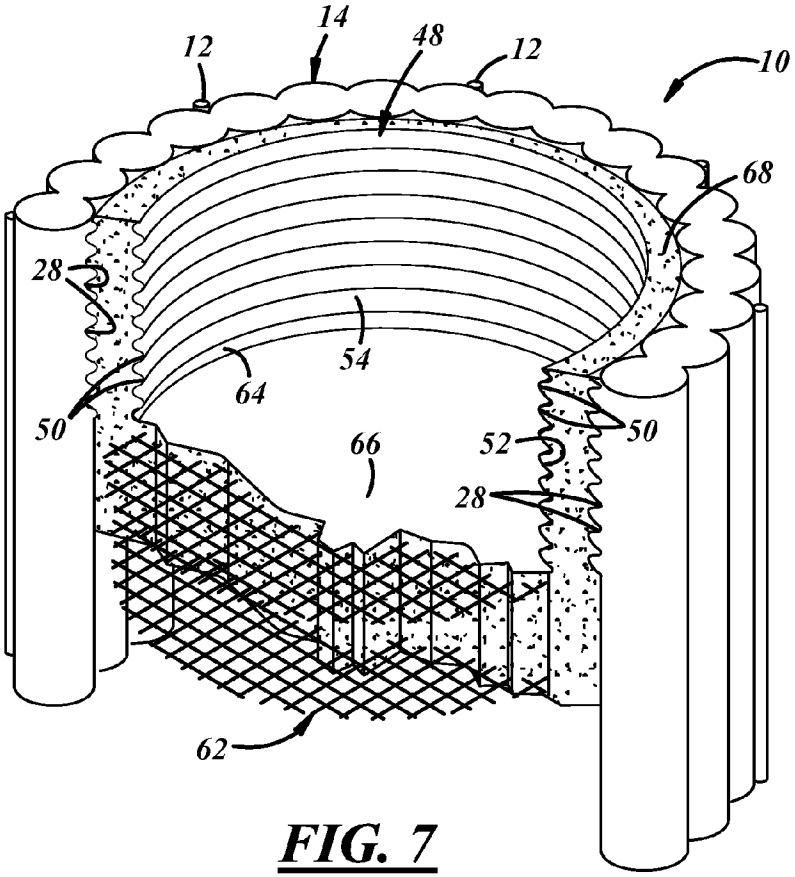
FIG. 7 is an enlarged perspective view with portions broken away and in section of a base of the shaft construction of FIG. 1.
Figure 8:
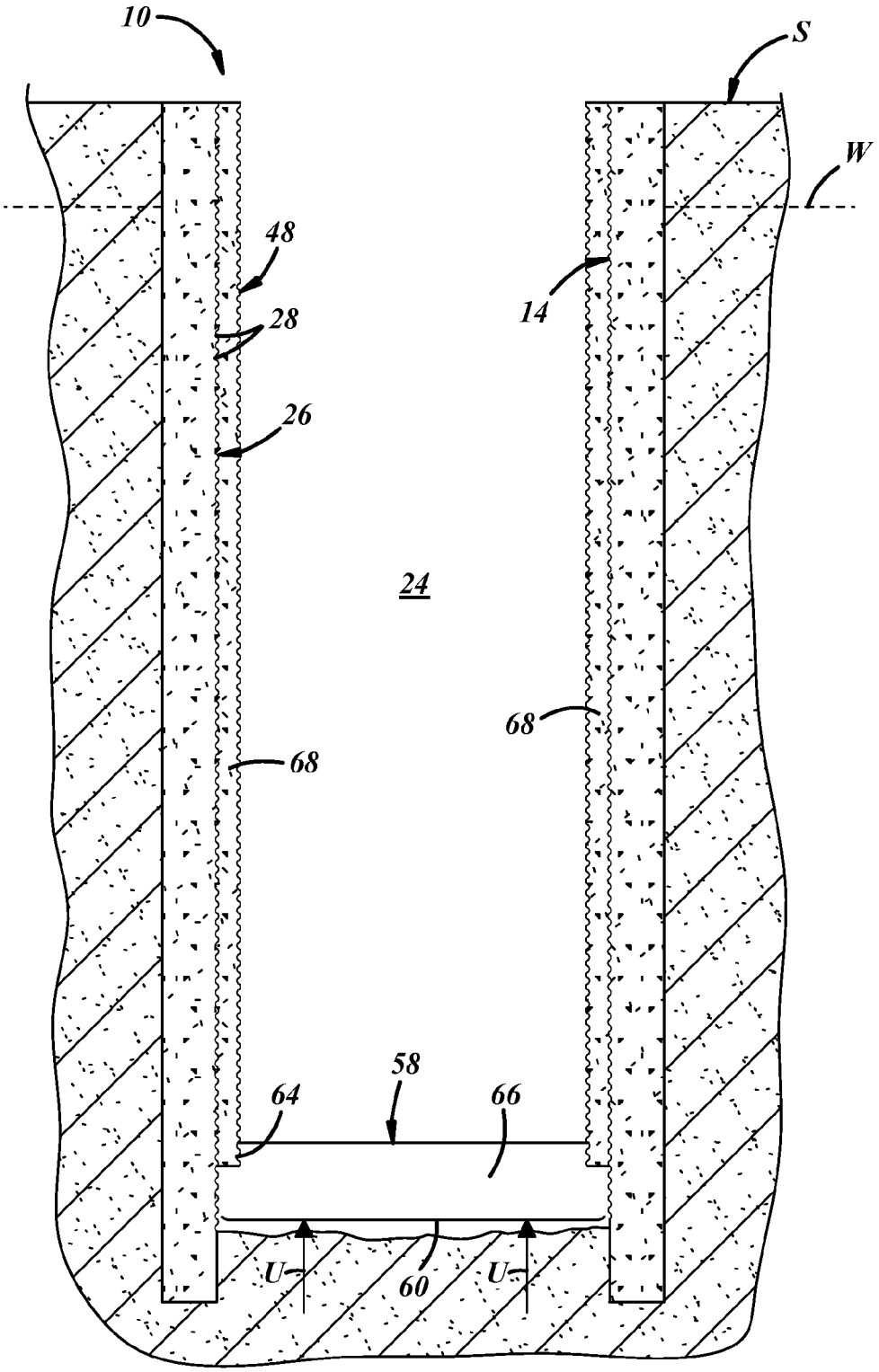
FIG. 8 is a full sectional view of the shaft construction of FIG. 1.

With the inside surface 26 exposed, recesses 28 can be formed into the inside surface for subsequently receiving grout material during the grout material filling process and for generating friction against uplift forces upon final construction, both of which are described in greater detail below. The recesses 28 are shown best in FIGS. 7 and 8. Although shown as wavy indentations, the recesses 28 can take multiple forms so long as they have the ability to generate friction against uplift forces. For example, the recesses 28 can simply be crude scrapes or gashes in the inside surface 26, or can be more refined indentations such as the wavy profile shown or discrete notches randomly located or patterned on the inside surface. In the example of FIGS. 7 and 8, the recesses 28 take the form of multiple grooves defined in the secant pile wall 14 and disposed all the way top-to-bottom between the open and closed ends of the shaft construction 10; an individual groove can extend circumferentially around the inside surface 26, or the recesses 28 can be a single coarse spiral stretching between the open and closed ends. In other examples, the recesses 28 can extend along the full axial extent of the inside surface 26 between the open and closed ends of the shaft construction 10, can extend along only a section of the inside surface such as a lower or upper or middle section, or can extend randomly on the inside surface. The recesses 28 are not limited to any particular form, shape, pattern, or quantity.

Figure 5:
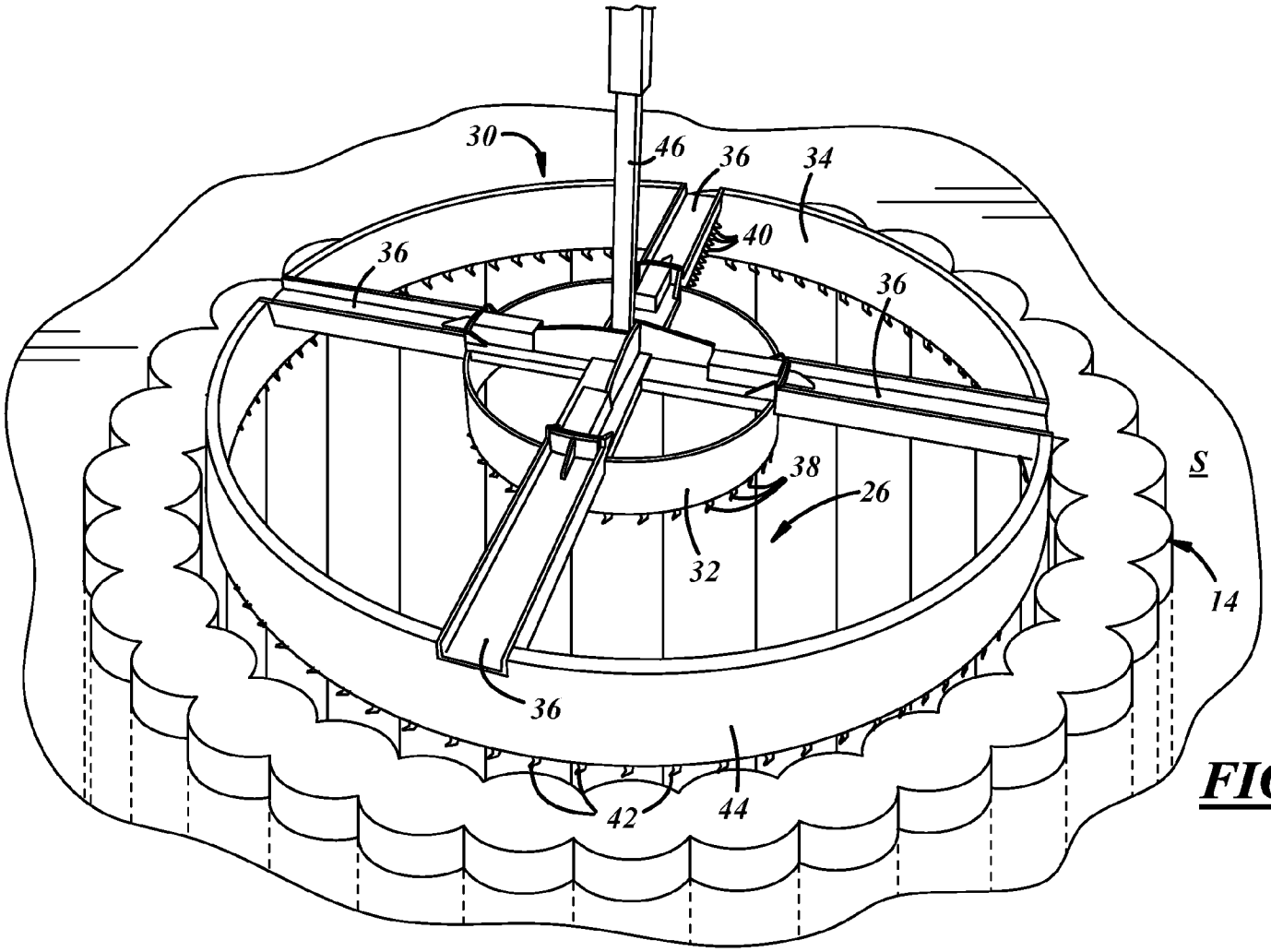
FIG. 5 is a perspective view of an embodiment of a scarifying tool.

Whatever their form, the recesses 28 can be produced by any suitable technique and tooling. For example, FIG. 5 shows a scarifying tool 30 that can be used to score the secant pile wall 14 and create the recesses 28 on the inside surface 26 in the form of scraped grooves. In this embodiment, the scarifying tool 30 is a multi-piece metal structure composed of an inner ring 32, an outer ring 34, and four cross-bars 36 welded or bolted to and supporting the inner and outer rings. The inner ring 32 can have a plurality of first cutting teeth 38 attached to and extending from its bottom end for facilitating additional excavation in the event that the interior 24 was previously incompletely excavated. Likewise, one or more of the cross-bar(s) 36 can have a plurality of second cutting teeth 40 attached to and extending from their bottom end(s). And, a plurality of third cutting teeth 42 can be attached to and can extend from a bottom end of the outer ring 34. In this embodiment, in order to be in position to make contact with the inside surface 26, the third cutting teeth 42 project radially-outwardly beyond a side surface 44 of the outer ring 34. The third cutting teeth 42 are also spaced continuously around the circumference of the outer ring 34. The scarifying tool can have other designs, constructions, and components in other embodiments, with the precise design, construction, and component(s) dictated in part or more by the form of recesses to be created.

In use, a crane arm 46 may be securely coupled to the scarifying tool 30, and may forcibly rotate the scarifying tool and move it axially up and down in the interior 24 defined by the secant pile wall 14. The outer ring 34 is sized diametrically so that the third cutting teeth 42 engage the inside surface 26 and score the inside surface to form the recesses 28. This scarifying operation can be performed with or without water in the interior 24.

Figure 6:
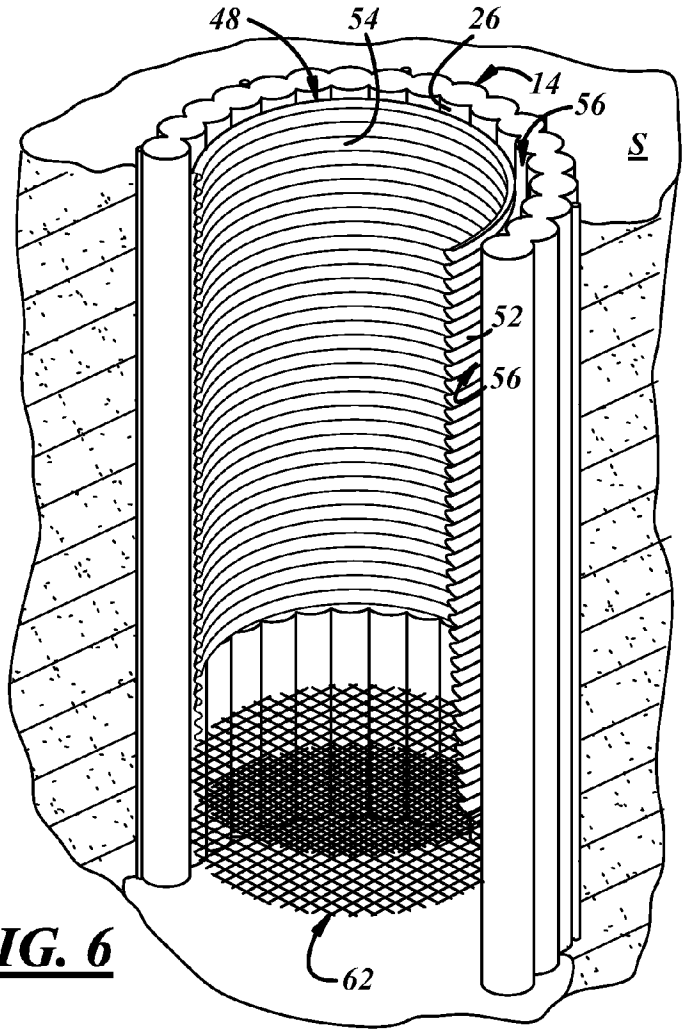
FIG. 6 is a fragmentary sectional view of the shaft construction of FIG. 1, illustrating an embodiment of a metal liner and an embodiment of a rebar cage.

Referring now to FIG. 6, after the secant pile wall installation process is completed and the scarifying finished, the metal liner placement process is performed in order to insert a metal liner 48 within the interior 24 of the shaft construction 10 and radially-inwardly and inboard of the secant pile wall 14. The metal liner 48 helps seal against groundwater inflow in the fully constructed shaft construction 10. The exact metal liner placement process, and metal liner component itself, can vary among different projects and applications and embodiments. In the embodiment of FIGS. 6 and 7, the metal liner 48 is a multi-piece cylindrical structure made up of discrete metal liner segments that are connected together via bolting, welding, or another connection technique. In one specific example, the metal liner segments are made of steel and have an approximately one-eighth inch thickness. The metal liner segments can be fully cylindrical segments or partial cylindrical segments. In the embodiment of the figures, the metal liner 48 has a corrugated structure with multiple recesses 50 on both outside and inside surfaces 52, 54. Although the recesses 50 are shown somewhat complementary to the recesses 28 in this embodiment, in other embodiments the recesses need not be complementary at all and one recess could be scrapes while the other could be discrete and random indentations. Its corrugated structure aids in the overall structural integrity of the metal liner 48, but need not necessarily take this form. Like the recesses 28 of the secant pile wall 14, the recesses 50 subsequently receive grout material during the grout material filling process.

In the placement process, the metal liner segments can be connected together before insertion, and the assembled metal liner 48 can then be hoisted above the interior 24 and lowered into the interior via a crane. As an assembly, the metal liner 48 can extend the full axial extent of the shaft construction 10, and can be sized with a diameter less than that of the secant pile wall 14. As shown best in FIG. 6, a space 56 is therefore defined between the outside surface 52 of the lowered metal liner 48 and the inside surface 26 of the secant pile wall 14. In one specific example, the space 56 can measure approximately twelve inches from surface-to-surface, but of course other examples are possible.

Additionally, one or more seal(s) can be provided between the connected metal liner segments or at the fully assembled metal liner 48 in order to augment the sealing performance against groundwater intrusion. The seal(s) can take different forms in different examples. In one example, the seal includes multiple rubber gaskets that are bolted or otherwise disposed between the discrete metal liner segments. In another example, the seal can be applied to the fully assembled metal liner 48 in the form of a sprayed epoxy sealer. Still other examples can include stuck-on sealers, glue-based sealers, or tar-based sealers, among other possibilities. And although not shown, a cutout can be located in the metal liner 48 near its lower end for providing access for the subsequent tunnel digging operation.

Furthermore, a water stop assembly can be provided at a lower end 64 of the metal liner 48. In one example, the water stop assembly includes a first ring-shaped steel plate welded to the inside surface 54 of the metal liner 48 and projecting radially-inwardly therefrom, and includes a second ring-shaped steel plate welded to the outside surface 52 and projecting radially-outwardly therefrom. The first and second ring-shaped steel plates can extend fully circumferentially around the metal liner 48. In one specific example, the ring-shaped steel plates have a thickness of approximately one-half inches; of course, other thicknesses are possible in other examples. Additionally, the water stop assembly can include a first tubing that can be injected with a grout material, such as a chemical-based grout, and is positioned on the outside surface 52 of the metal liner 48 opposite the first ring-shaped steel plate. Likewise, a second tubing that can be injected with a grout material, such as a chemical-based grout, is positioned on the inside surface 54 opposite the second ring-shaped steel plate. In one specific example, the first and second tubings have a diameter of approximately one-half inches; of course, other diameters are possible in other examples. Still, the water stop assembly can have other designs, constructions, and components than described here.

The base plug installation process is performed in order to establish a secured and sealed base plug 58 at the bottom of the shaft construction 10. The base plug installation process, and base plug 58 itself, can vary among different projects and applications and embodiments. In the embodiment of FIGS. 6-8, a mud mat 60 composed of a concrete material is first laid on the floor over the exposed earth of the excavated interior 24 (the mud mat is represented by an upwardly-facing bracket in FIG. 8). The mud mat 60 can be poured via a tremie concrete pouring technique with a pipe submerged in groundwater sitting in the interior 24, and can be laid before the metal liner 48 is inserted into the interior. Once the mud mat 60 is hardened, a rebar cage 62 of steel can be lowered on top of the mud mat—again, this step can be performed before the metal liner 48 is inserted into the interior 24. The rebar cage 62, if provided, serves as a reinforcement and structural skeleton of the base plug 58.

At this point in time, the previously-described lowering of the metal liner 48 can take place; the metal liner can be lowered so that the lower end 64 of the metal liner is positioned close to the rebar cage 62, abutting the rebar cage, or even slightly below an upper part of the rebar cage. In this embodiment, a concrete material is then poured over the rebar cage 62 via a tremie concrete pouring technique, if suitable, until the rebar cage is completely submerged in the concrete material. The hardened concrete material constitutes a base slab 66 of the base plug 58. The base slab 66 can be poured to immerse and embed the lower end 64 of the metal liner 48 within the hardened concrete material. If the water stop assembly is provided, the base slab 66 can be poured to also immerse the water stop assembly including its steel plates and its tubings. This secures the base slab 66 and the metal liner 48 together at the lower end 64, and augments the sealing performance of the shaft construction 10; the immersed water stop assembly in particular ensures sealing performance if there is undesired shrinkage of the base slab 66 upon hardening which could otherwise leave a gap between the base slab and the lower end 64. In one specific example, the base plug 58 is approximately five feet in overall vertical and axial thickness. In different embodiments, the sequence of metal liner placement and base plug installation could differ; for example, the mud mat could be laid, the metal liner could be placed, and then the rebar cage could be lowered; and in another example, the metal liner could be placed, the mud mat could be laid, and then the rebar cage could be lowered, followed by the pouring of the base slab material.

Figure 9:
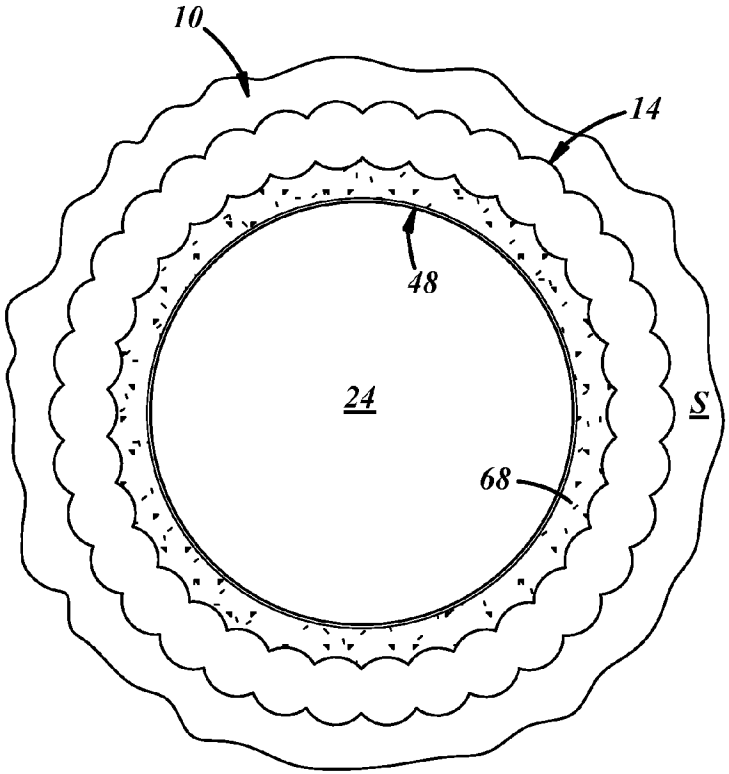
FIG. 9 is a top view of the shaft construction of FIG. 1.

The grout material filling process is performed to finalize the shaft construction 10 and fill the annular space 56 between the secant pile wall 14 and the metal liner 48. The grout material filling process can vary among different projects and applications and embodiments. In the embodiment of FIGS. 7-9, a grout material 68, such as what-is-known-as neat grout, is poured into the space 56 until the space is completely full of grout material. The grout material 68 can fill in both the recesses 28 of the secant pile wall 14 and the recesses 50 of the metal liner 48, and can harden therein. In this way, the grout material 68 can harden with protrusions received in the recesses 28, 50. After all of the materials have fully hardened and set, the shaft construction 10 can be dewatered, if needed. Moreover, the shaft construction 10 seals against groundwater intrusion without the need to dewater the pre-established working zone, though this can be performed if desired.

Referring now only to FIG. 8, when constructed below a water table W and in earth porous and imbued in groundwater, resulting uplift forces U are constantly exerted against the base plug 58. As shown and described herein, the shaft construction 10 has been designed with certain measures to withstand and counteract and oppose these exerted uplift forces U. One measure is the recesses 28 of the secant pile wall 14 filled with the grout material 68. This generates friction and provides a mechanical interlocking functionality between the secant pile wall 14 and the grout material 68 that can hold the components of the shaft construction 10 in place. Another measure is the recesses 50 of the metal liner 48 filled with the grout material 68. Again, this generates friction and provides a mechanical interlocking functionality between the metal liner 48 and the grout material 68 that can hold the components of the shaft construction 10 in place. Yet another measure is the lower end 64 of the metal liner 48 immersed and captured in the base slab 66. Not all of these measures need to be provided in the shaft construction 10, as only one of the measures may sufficiently withstand the uplift forces U exerted in a particular application. Indeed, in one embodiment, neither recesses 28 nor 50 need to be provided, as sufficient friction may be generated between the metal liner 48 and grout material 68 and between the secant pile wall 14 and grout material to withstand the uplift forces U.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A method of constructing a shaft in the earth, the method comprising:

installing a secant pile wall into the earth, said secant pile wall enclosing a portion of the earth;

excavating the portion of the earth enclosed by said secant pile wall, the excavated portion leaving an interior of the shaft and exposing an inside surface of said secant pile wall scarifying at least a section of said inside surface of said secant pile wall to form a plurality of recesses in said inside surface to receive said grout material;

placing a metal liner within said interior of the shaft;

at least partially filling a space located between said inside surface of said secant pile wall and said metal liner with a grout material;

placing a rebar cage adjacent a base of the shaft; and pouring a concrete material over said rebar cage to immerse a lower end of said metal liner in said concrete material.

2. The method of claim 1, further comprising treating a pre-established working zone of earth with a grout material before installing said secant pile wall at said pre-established working zone of earth.

3. The method of claim 1 further comprising dewatering said interior after said grout material and said concrete material have hardened.

4. The method of claim 1, further comprising providing a seal at said metal liner.

5. The method of claim 4, wherein said seal is at least one gasket disposed between at least a pair of segments of said metal liner.

6. The method of claim 1, wherein said metal liner has a corrugated structure with a plurality of recesses, and said grout material is filled in said plurality of recesses.

7. The method of claim 1, wherein friction generated between said grout material and at least one of said secant pile wall or said metal line withstands uplift forces resulting from groundwater in the earth adjacent the shaft.

8. A shaft construction constructed by the method of claim 1.

9. A method of constructing a shaft in the earth, the method comprising:

installing a secant pile wall into the earth, said secant pile wall enclosing a portion of the earth;

excavating the portion of the earth enclosed by said secant pile wall, the excavated portion leaving an interior of the shaft and exposing an inside surface of said secant pile wall;

forming at least one first recess in said inside surface of said secant pile wall;

placing a metal liner within said interior of the shaft, said metal liner having at least one second recess located in its structure; and at least partially filling a space located between said inside surface of said secant pile wall and said metal liner with a grout material, said grout material filling in said at least one first recess and filling in said at least one second recess, wherein friction generated between said grout material and said at least one first recess and between said grout material and said at least one second recess withstand groundwater uplift forces.

10. The method of claim 9, further comprising pouring a concrete material to a base of the shaft, the concrete material immersing a lower end of said metal liner and hardening over said lower end.

11. The method of claim 9, wherein said forming step includes scarifying at least a section of said inside surface of said secant pile wall to form a plurality of recesses in said inside surface to receive said grout material.

12. The method of claim 11, wherein the forming step includes using a crane arm to rotate a scarifying tool and move the tool axially within the interior.

13. A shaft construction constructed by the method of claim 10.

14. A method of constructing a shaft in the earth, the method comprising:

excavating a portion of the earth enclosed by a secant pile wall to expose an inside surface of the secant pile wall;

installing a base plug at a bottom of the shaft, including pouring concrete;

placing a metal liner radially spaced inside of the inside surface of secant pile wall, such that a bottom end of the metal liner is captured in the base plug; and at least partially filling a space located between the inside surface of the secant pile wall and the metal liner with a grout material.

15. A shaft construction constructed by the method of claim 14.

* * * * *